US005118149A

United States Patent [19]

Emmons

[11] Patent Number: 5,118,149

[45] Date of Patent: Jun. 2, 1992

[54] CONTAINER HASP PROTECTOR

[76] Inventor: Robert F. Emmons, 244 Beachnut Dr., Hercules, Calif. 94547

[21] Appl. No.: 712,969

[22] Filed: Jun. 10, 1991

[51] Int. Cl.[5] ..... E05B 67/38

[52] U.S. Cl. ..... 292/327; 292/DIG. 2; 292/205; 70/56

[58] Field of Search ..... 292/327, 218, DIG. 2, 292/1, 337, 205; 70/54, 55, 56

[56] References Cited

U.S. PATENT DOCUMENTS

| | | | |
|---|---|---|---|
| 1,248,293 | 11/1917 | Ellington | 70/56 |
| 1,835,100 | 12/1931 | Symington | 292/218 |
| 3,151,898 | 10/1964 | Olander | 292/218 X |
| 4,157,653 | 6/1979 | Dohanyos | 70/56 X |
| 4,458,510 | 7/1984 | Nielsen | 70/56 X |
| 4,898,008 | 2/1990 | Eberly | 70/56 |

*Primary Examiner*—Richard E. Moore

*Attorney, Agent, or Firm*—Douglas E. White

[57] ABSTRACT

Protector apparatus for a hasp of a shipping container of the type having a pair of alignable hasp apertures includes a metal box-shaped body having a top plate, a bottom plate, right and left side plates, an open rear face, and a front face. The apparatus further includes a shield plate on the face of the body extending transversely between the side plates and forming a top opening in the face between the shield plate and the top plate and forming a bottom opening between the shield plate and the bottom plate. A shield aperture in the shielf plate is alignable with the hasp apertures, through all of which apertures a breakaway seal may be threaded for securing the breakaway security seal to the hasp and to the body of the protector. The body supports itself on the hasp and protects the hasp from intentional breakage.

12 Claims, 2 Drawing Sheets

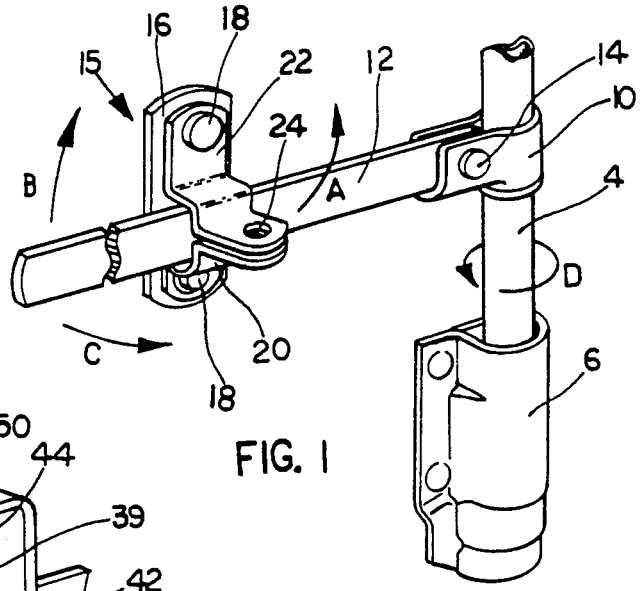
FIG. 1
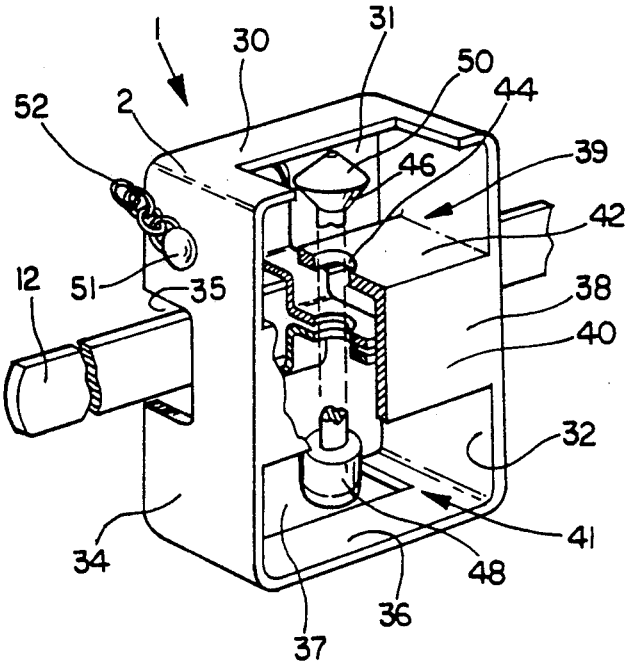
FIG. 2
FIG. 3
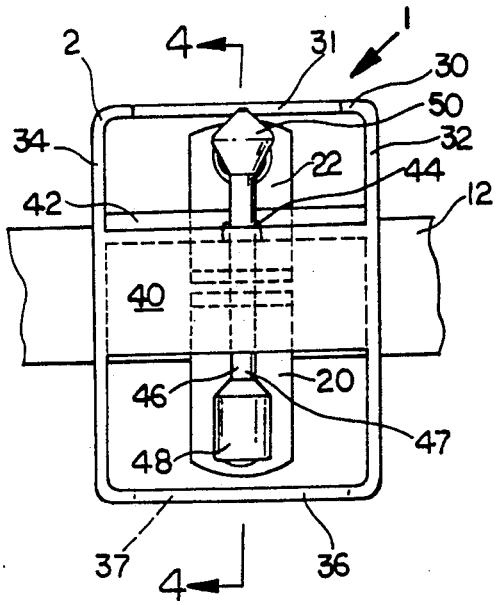
FIG. 4
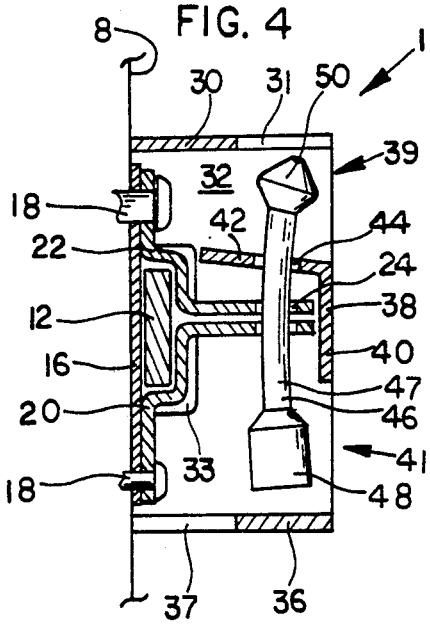

CONTAINER HASP PROTECTOR

FIELD OF THE INVENTION

This invention relates to lock guards, more particularly to a hasp protector for shipping containers.

BACKGROUND OF THE INVENTION

Standard shipping containers, i.e. those used interchangeably on ships, trains and trucks, are often broken into during transit. For example, when they are transported on a train, a thief may stow away on the train and have a long period during which to attempt a break-in. Typically, the thief will chisel open the hasp which secures the locking handle. This hasp has two main weak points. One is the relatively narrow area surrounding the hole for the locking pin of the security seal and the other is the same area around the bolts that attach the hasp to the container door.

While the hasp might be sealed with a lock, typically it will be sealed with a disposable security seal, known in the industry as a "breakaway security seal" and readily available. These seals are used because the ultimate recipient of a shipment originating abroad cannot be expected to have a key or know a combination. However, a legitimate user can readily obtain a special tool that can be used to snap open the breakaway seal, which then must be discarded. Such seals have a vertical center pin that extends through the holes in the hasp in the manner of the shackle of a padlock. With the advent of such seals, thieves now usually attack the hasp itself.

It is therefore desired to produce a hasp protector with the following characteristics. First of all, it should protect both the particular type of hasp used on shipping containers and also the special breakaway seal. Secondly, the protector should be self-supporting, so that the container need not itself be modified for its use, insofar as the container may belong to someone other than the entity applying the protector (the latter may be, for example, a railroad company). Finally, the protector should be relatively simple to construct at low cost—the railroad may never see the protector again once the container is delivered to the customer.

Prior developments in this field may be generally illustrated by reference to the following patents:

| Patent No. | Patentee | Issue Date |
|---|---|---|
| 3,736,016 | C. Garvey et al. | May 29, 1973 |
| 4,898,008 | D. Eberly | Feb. 06, 1990 |
| 4,581,907 | D. Eberly | Apr. 15, 1986 |
| 4,389,862 | T. Hastings | Jun. 28, 1983 |
| 4,096,718 | L. Michelman et al. | Jun. 27, 1978 |
| 4,895,007 | D. Eberly | Jan. 23, 1990 |
| 4,324,426 | T. Michelson | Apr. 13, 1982 |
| 4,742,701 | D. Scavetto | May 10, 1988 |

U.S. Pat. No. 4,096,718 shows a self-supporting lock protector for a lock of the general shape of the breakaway security seals used on shipping containers. The seal described therein, however, is re-usable and key-operated. The hasp is built into the protector itself. The remainder of the patents show devices for protecting key-operated locks having standard U-shaped locking shackles.

U.S. Pat. No. 3,736,016 shows a box-shaped hasp protector for truck trailers, which protector is bolted to the trailer door.

U.S. Pat. No. 4,898,008 shows a bolt-on replacement hasp which incorporates protection for the shackle of the lock.

U.S. Pat. No. 4,895,007 teaches a box-shaped security device which is self-supporting and which protects the lock and its shackle, but which does not protect the rotating portion of the hasp.

U.S. Pat. No. 4,389,862 shows a locking assembly which does not protect the hasp, but which instead secures the locking rods themselves.

The rest of the patents are representative of what is in the art.

SUMMARY OF THE INVENTION

The present invention is a hasp protector which reinforces the hasp by making it difficult or impossible to reach and attack the weak points of the hasp with a chisel, bolt cutter, or similar tool.

A first embodiment has a box-shaped body with a shield plate on its front face which protects the most vulnerable forward-facing portions of the hasp. The shield is bent back to form a member which attaches to the security seal so as to render the protector self-supporting. Top, bottom and side plates protect the remainder of the hasp. Access to the hasp (for attaching the security seal) is gained through openings in the face and through notches in the top and bottom plates.

A second embodiment is a cap of curved or semi-spherical shape. Access to the hasp is through a slot or slots in the front of the cap. A pair of hasp shield plates extend down from the slots into the interior of the cap, where they fit over the top of the hasp. Placing the pin of the security seal through holes in the shield plates causes the shield plates both to hold the cap on over the hasp and to protect the hasp from access by a chisel.

Both embodiments may be permanently anchored to the container by chains for later re-use.

FEATURES AND ADVANTAGES

An object of this invention is to provide hasp protector apparatus for a hasp of a shipping container of the type having a pair of alignable hasp apertures, which apparatus includes a metal box-shaped body having a top plate, a bottom plate, right and left side plates, an open rear face, and a front face. The apparatus further includes a shield plate on the face of the body extending transversely between the side plates and forming a top opening in the face between the shield plate and the top plate and forming a bottom opening between the shield plate and the bottom plate. A shield aperture in the shield plate is alignable with the hasp apertures, through all of which apertures a breakaway seal may be threaded, for securing the breakaway security seal to the hasp and to the body of the protector. The body supports itself on the hasp and protects the hasp from intentional breakage.

Another feature or advantage is that the apparatus may further include a generally horizontal member of the shield plate, the horizontal member extending transversely between the side plates, into which horizontal member the shield aperture is formed, wherein all of the apertures may be vertically aligned.

Yet another feature is that the apparatus may include a first slot in the right side plate leading to the rear face, and a second slot in the left side plate leading to the rear face for accommodating the locking handle of the container.

Still another feature is that the apparatus may further include third slot in the top plate leading to the top opening, and a fourth slot in the bottom plate leading to the rear face for providing access to the breakaway seal.

Another advantage is that the apparatus may further include a chain riveted to the body for keeping the protector loosely attached to the container door even after it has been removed from the hasp.

Another feature is an apparatus which is easy to use, attractive in appearance and suitable for mass production at relatively low cost.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, the words "upwardly," "downwardly," "leftwardly," and "rightwardly" will refer to directions in the drawings to which reference is made. The words "inwardly" and "outwardly" will refer to directions toward and away from, respectively, the geometric center of a device and designated parts thereof.

BRIEF DESCRIPTION OF THE DRAWING

FIG. 1 is a perspective view of the environment in which the present invention is adapted for use, namely a hasp sealed container door;

FIG. 2 is a partially broken perspective view of a preferred hasp protector of this invention;

FIG. 3 is a front elevation of the device of FIG. 2;

FIG. 4 is a sectional side elevation of the device of FIG. 2, taken along line 4—4 of FIG. 3;

DRAWING REFERENCE NUMERALS

Figure 6:
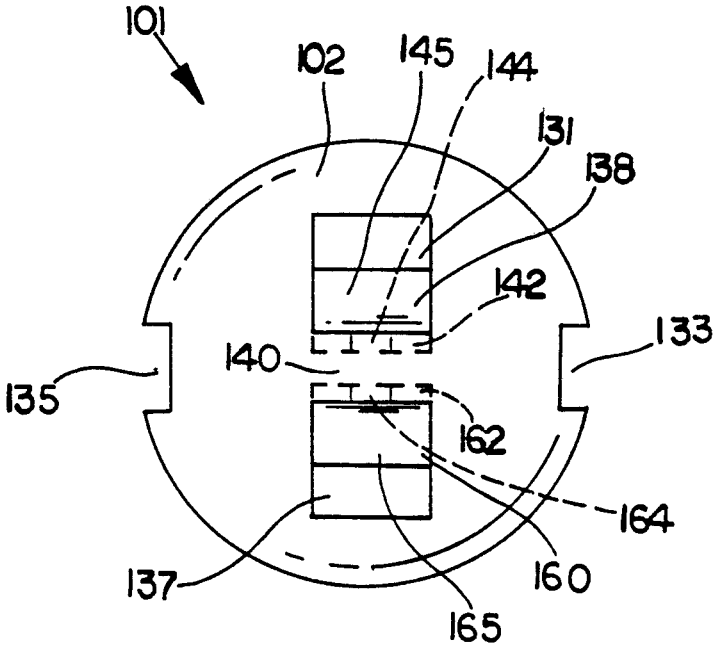
FIG. 6 is a front elevation of the device of FIG. 5.
Figure 5:
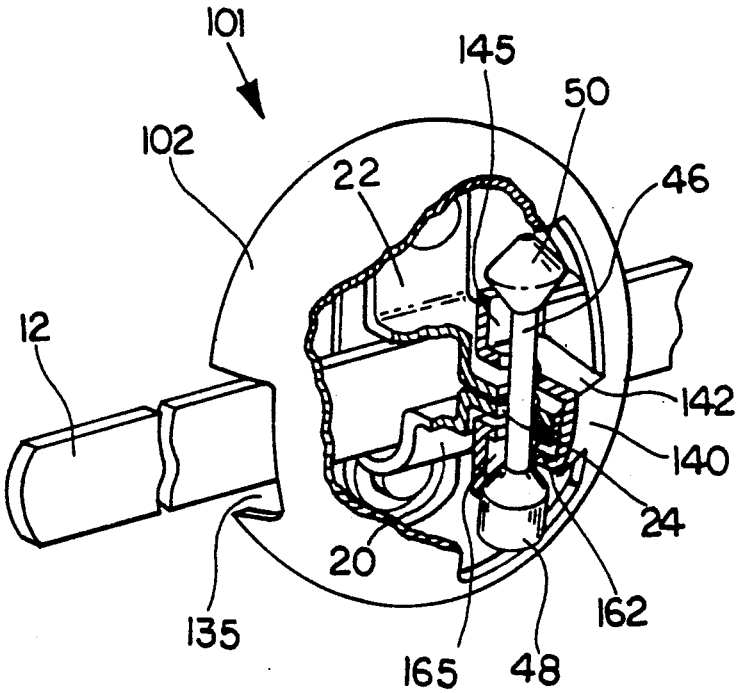
FIG. 5 is a partially broken perspective view of an alternate embodiment of the invention.

A: arrow
B: arrow
C: arrow
D: arrow
1: hasp protector
2: body of 1
4: locking bar
6: door bracket for 4
8: door
10: bar bracket for 12
12: locking handle
14: pivot bolt
15: hasp
16: hasp plate
18: bolts for 16, 20, 22
20: fixed hasp member
22: rotating hasp member
24: apertures in 20, 22
30: top plate
31: slot in 30
32: right side plate
33: slot in 32
34: left side plate
35: slot in 34
36: bottom plate
37: slot in 36
38: shield plate
39: top facial opening
40: vertical member of 38
41: I bottom facial opening
42: horizontal member of 38
44: aperture in 42
46: breakaway security seal
47: pin of 46
48: bottom cap of 46
50: top cap of 46
51: rivet
52: chain
101: hasp protector
131: upper front slot in 102
133: right side slot in 102
135: left side slot in 102
137: lower front slot in 102
138: upper shield plate
140: vertical member of 138
142: horizontal member or 138
144: aperture in 142
145: rear member of 138
160: lower shield plate
162: horizontal member of 160
164: aperture in 162
165: rear member of 160

DESCRIPTION OF A PREFERRED EMBODIMENT

Referring to FIG. 1, there is illustrated therein a preferred container hasp protector 1 of this invention. Hasp protector 1 is used on a shipping container door having normally having at least the following parts. A locking bar 4 is rotatably attached to the container door by means of brackets such as door bracket 6. The locking bar mechanism is standard. Its operation, therefore, will only be described in enough detail to explain the working environment of the invention. It terminates in a locking cam releasably held in a keeper (not illustrated). A bracket 10 on the bar holds a locking handle 12, which handle may pivot in a vertical plane about a pivot bolt 14.

When the door is closed and secure, the locking handle is captured within a hasp 15. The hasp typically has a backing plate 16 and a pair of hasp members 20, 22, all of which are affixed to the door 8 (FIG. 4) by means of two or more bolts 18. A lower hasp member 20 is fixed in place, while the upper hasp member 22 is free to rotate in a vertical plane about the axis of its attachment bolt. A matched pair of holes or apertures 24 in the outer or forward portions of members 20, 22 are axially aligned when the hasp is closed upon the locking handle 12, so that the handle may be secured in place by threading a lock or breakaway seal through the apertures 24.

When it is desired to open the door 8, the hasp is unlocked (or the security seal is broken). This allows the rotating hasp member 22 to be rotated up out of the way in the direction of arrow A. Moving the locking handle upward in the direction of arrow B releases it from the lower fixed hasp member 20 so that it may be pulled away from the door in the direction of arrow C. This causes the locking bar 4 to rotate in the direction of arrow D, releasing the door. The door may be secured shut by following this procedure in reverse.

Turning to FIGS. 2–4, it can be seen that the container hasp protector 1 has a box-shaped body 2 comprising a top plate 30, a right side plate 32, a left side plate 34, a bottom plate 36, and a two-part shield plate 38. The rear face of the device is completely open. All of these plates are formed of suitably tamper-resistant material, such as hardened steel or the like. They are either bent into shape or welded securely together.

The top plate 30 forms a central slot 31 which opens toward the front face of the body 2. The bottom plate 36 has a similarly-shaped central slot 37 which opens toward the rear of the body. A pair of aligned central slots 33, 35, in right and left side plates 32, 34, respectively, open to the rear of the body and are used to accommodate the height and thickness of the locking handle 12, in order that the protector may fit flush against the face of the door 8.

The front face has a centrally placed shield plate 38 that extends transversely between the side plates 32, 34. It is comprised of a vertical facial member 40 and a generally horizontal, but very slightly upwardly canted, "horizontal" member 42. A circular aperture 44 is formed in the center of the horizontal member. This aperture may be aligned along the same axis as the pair of lock-attachment apertures 24 of the hasp members 20, 22. The pin or shaft 47 of a breakaway security seal 46 may be inserted through the three aligned apertures 44, 24, 24. This will hold the protector I in place over the hasp 15 so as to render it self-supporting.

The vertical member 40 of the shield 38 is high enough to cover the front portions of the hasp members 20, 22 from attack by chisels, bolt cutters or other burglar tools, yet is short enough to allow authorized personnel to access the breakaway seal 46 through top and bottom facial openings 39, 41.

The hasp protector 1 is installed in the following manner. Once the locking handle 12 is contained within the hasp 15 as illustrated in FIG. 1, the body 2 of the protector is pressed flush against the vertical surface of the container door 8. The locking handle extends freely out the side plates 32, 34 through slots 31, 33. The breakaway seal 46 comes with only its top cap 50 affixed to the pin 47. The pin may be threaded downwardly through the top slot 31 and top facial opening 39 into the aligned apertures 44, 24, 24. From either the bottom slot 37 or the bottom facial opening 41, one can snap the bottom cap 48 onto the pin 47 of the seal 46.

Once on the pin, the bottom cap may not later be removed. Therefore, the protector 1 is locked onto the hasp 15 until the seal is broken by authorized personnel. The hasp is protected from attack with burglar tools by the body 2 and shield plate 38, as well as by the obstruction formed by the parts of the breakaway seal 46. The seal 4 is also shielded from all but a direct frontal attack, which type of attack it was designed to resist.

To remove the protector and open the hasp, a seal-removal tool (not illustrated) is available especially for breaking this type of seal. The use of the seal-removal tool requires that it be aligned with the seal vertically, that it capture the caps of the seal and that it snap off the top cap 50 of the seal. For this task, the tool is inserted through the forward top plate slot 31 and the top facial opening 39. With this configuration, one has no difficulty operating the seal-removal tool.

In case the protector is intended to remain with the container after removal, it may be tethered to a part thereof. For example, a chain 52 affixed to the body 2 by means such as a rivet 51 can lead to a clamp on one of the locking bars 4.

Turning to FIGS. 6 and 7, a second embodiment of the invention is shown therein, namely, container hasp protector 101. It is to be noted that, for convenience, the last two positions of the reference numerals of alternate embodiments of the invention duplicate those of the numerals of the embodiment of FIG. 1, where reference is made to similar or corresponding parts. Insofar as this embodiment may be used in the identical environment as the previous embodiment, the parts of the general environment retain their original numerals.

Protector 101 is comprised of a rounded body or cap 102. The cap is constructed of suitably tamper-resistant metal and may be molded or stamped in shape. The rounded contour of the cap 102 may be of value in preventing burglar tools from gaining purchase on the protector for the purpose of destroying or defeating it. Access to the interior of the device for the purpose of installing a breakaway seal 46 is through a vertically aligned pair of front slots, namely, upper front slot 131 and lower front slot 137.

The locking handle 12 protrudes through right 133 and left 135 side slots. At least one shield plate, namely upper shield plate 138, extends inwardly through a front slot into the body of the protector 101 The front slots 131, 137 form a vertical member 140 of the shield plate, which member is connected to a generally horizontal member 142. An aperture 144 in member 142 aligns with the aligned pair of apertures in the hasp members, as previously described. Optionally, a rear member 145 may rise vertically from the rear of the shield plate 138 for additional protection.

Another option, on this or the previous embodiment, is a second shield plate, namely, lower shield plate 160. Lower shield 160 shares the vertical member 140 with the upper shield 138. The generally horizontal member 162 may terminate in a vertical rear member 165. The horizontal member 162 also has a central aperture 164 through which a breakaway seal 46 may pass. It can be seen that the slots 131, 137 might be formed (along with the upper 138 and lower 160 shield plates) in a single, simple stamping operation.

It can be seen that installation of a breakaway seal 46 through aligned apertures 144, 24, 24, 164 will lock a handle 12 between the rotating 22 and fixed 20 members of a container hasp. The protector 101 will then be self-supporting. The top cap 50 and bottom cap 48 of the seal may be accessed for later removal of the seal by authorized personnel.

While the above provides a full and complete disclosure of the preferred embodiments of this invention, various modifications, alternate constructions, and equivalents may be employed without departing from the true spirit and scope of the invention. Such changes might involve alternate materials, components, structural arrangements, sizes, operational features or the like. As just one of many possible examples, the chain 52 could just as well be a cable or wire. Therefore, the above description and illustrations should not be construed as limiting the scope of the invention which is defined by the appended claims.

What is claimed is:

1. Protector apparatus for a hasp of a shipping container of the type having a pair of alignable hasp apertures, the apparatus including:

body means for surrounding the hasp and for shielding it from intentional breakage by tools approaching from the top, bottom and sides of the hasp;

shield plate means on the body for shielding the hasp from breakage by tools approaching from the front of the hasp;

aperture means in the shield plate means for securing a breakaway security seal to the hasp and to the body, whereby the body supports itself on the hasp and protects the hasp from intentional breakage.

2. Protector apparatus for a hasp of a shipping container of the type having a pair of alignable hasp apertures, the apparatus including;

a box-shaped body having a top plate, a bottom plate, right and left side plates, a rear face, and a front face; and a shield plate on the face of the body extending transversely between the side plates and forming a top opening in the face between the shield plate and the top plate and forming a bottom opening between the shield plate and the bottom plate, the shield plate having means for securing a breakaway security seal to the hasp and to the body, whereby the body supports itself on the hasp and protects the hasp from intentional breakage.

3. The apparatus of claim 2 wherein:

the securing means includes a shield aperture in the shield plate which is alignable with the pair of hasp apertures and through all of which apertures the breakaway seal may be threaded.

4. The apparatus of claim 3 further including:

a generally horizontal member of the shield plate, the horizontal member extending transversely between the side plates, into which horizontal member the shield aperture is formed.

wherein all of the apertures may be vertically aligned.

5. The apparatus of claim 4 further including:

a first slot in the right side plate leading to the rear face; and a second slot in the left side plate leading to the rear face.

6. The apparatus of claim 5 further including:

a third slot in the top plate leading to the top opening; and a fourth slot in the bottom plate leading to the rear face.

7. The apparatus of claim 6 further including:

a chain attached to the body.

8. Protector apparatus for a hasp of a shipping container of the type having a pair of alignable hasp apertures, the apparatus including;

a metal box-shaped body having a top plate, a bottom plate, right and left side plates, an open rear face, and a front face;

a shield plate on the face of the body extending transversely between the side plates and forming a top opening in the face between the shield plate and the top plate and forming a bottom opening between the shield plate and the bottom plate; and a shield aperture in the shield plate which is alignable with the hasp apertures and through all which apertures a breakaway seal may be threaded for securing the breakaway security seal to the hasp and to the body, whereby the body supports itself on the hasp and protects the hasp from intentional breakage.

9. The apparatus of claim 8 further including:

a generally horizontal member of the shield plate, the horizontal member extending transversely between the side plate, into which horizontal member the shield aperture is formed, wherein all of the apertures may be vertically aligned.

10. The apparatus of claim 9 further including:

a first slot in the right side plate leading to the rear face; and a second slot in the left side plate leading to the rear face.

11. The apparatus of claim 10 further including:

a third slot i the top plate leading to the top opening; and a fourth slot in the bottom plate leading to the rear face.

12. The apparatus of claim 11 further including:

a chain attached to the body.

* * * * *